United States Patent [19]

Barrington

[11] Patent Number: 4,579,174

[45] Date of Patent: Apr. 1, 1986

[54] WELL TOOL WITH HYDRAULIC TIME DELAY

[75] Inventor: Burchus Q. Barrington, Duncan, Okla.

[73] Assignee: Halliburton Company, Duncan, Okla.

[21] Appl. No.: 650,311

[22] Filed: Sep. 12, 1984

[51] Int. Cl.[4] ..... E21B 34/12; E21B 49/08

[52] U.S. Cl. ..... 166/64; 166/264; 166/373; 166/386

[58] Field of Search ..... 166/64, 264, 324, 373, 166/386, 344; 175/59

[56] References Cited

U.S. PATENT DOCUMENTS

| | | | |
|---|---|---|---|
| 2,740,479 | 4/1956 | Schwegman | 166/145 |
| 2,978,046 | 4/1961 | True | 166/264 X |
| 3,435,897 | 4/1969 | Barrington | 166/226 |
| 3,664,415 | 5/1972 | Wray et al. | 166/264 X |
| 3,814,182 | 6/1974 | Giroux | 166/226 |
| 4,113,012 | 9/1978 | Evans et al. | 166/264 |
| 4,346,770 | 8/1982 | Beck | 175/297 |
| 4,417,622 | 11/1983 | Hyde | 166/264 |
| 4,422,506 | 12/1983 | Beck | 166/264 X |

*Primary Examiner*—Stephen J. Novosad
*Assistant Examiner*—John F. Letchford
*Attorney, Agent, or Firm*—L. Wayne Beavers; James R. Duzan; Thomas R. Weaver

[57] ABSTRACT

A well tool apparatus includes a housing adapted to be connected in a pipe string. A mandrel is slidably received in the housing and adapted to be selectively telescoped between first and second positions relative to the housing to manipulate an operating assembly of the apparatus. The mandrel is spaced radially inward from the housing to define a longitudinally extending metering chamber in which is received a metering cartridge which divides the metering chamber into first and second chamber portions. The metering cartridge has a fluid passage disposed therethrough joining the first and second chamber portions and has a flow restricter disposed therein. A sliding seal is provided between the metering cartridge and the housing. A selective seal is provided between the metering cartridge and the mandrel for temporarily sealing therebetween when the mandrel slides in a first direction relative to the housing thus requiring any fluid flow between the portions of the metering chamber to be through the fluid passage of the cartridge. The selective seal allows fluid flow between the portions of the metering chamber to bypass the fluid passage of the metering cartridge when the mandrel slides in a second direction opposite the first direction relative to the housing.

17 Claims, 12 Drawing Figures

WELL TOOL WITH HYDRAULIC TIME DELAY

BACKGROUND OF THE INVENTION

1. Field of the Invention

The present invention relates to well tools of the type having a mandrel telescopingly received within a housing and having a hydraulic metering means for metering a flow of fluid to impede movement of the mandrel within the housing so as to provide a time delay in such movement.

2. Description of the Prior Art

During the course of drilling an oil well, one operation which is often performed is to lower a testing string into the well to test the production capabilities of the hydrocarbon-producing underground formations intersected by the well. This testing is accomplished by lowering a string of pipe, commonly referred to as drill pipe, into the well with a formation tester valve attached to the lower end of the string of pipe and oriented in a closed position, and with a packer attached below the formation tester valve. This string of pipe with the attached testing equipment is generally referred to as a well test string.

Once the test string is lowered to the desired final position, the packer means is set to seal off the annulus between the test string and a well casing, and the formation tester valve is opened to allow the underground formation to produce through the test string.

One construction which is often used for operation of the formation tester valve, is an arrangement whereby the tester valve has a housing with a mandrel telescopingly received in the housing, and the valve of the tester valve is operated by setting down weight on the test string so as to telescopingly collapse the mandrel relative to the housing thereby opening the valve.

It is, however, necessary that the formation tester valve be able to transmit compressional hydraulic forces for relatively short periods of time without actuating the valve or closing the bypass port of the tool. This is necessary for a number of reasons. For example, when the well test string is being run into the well bore, the test string often encounters obstructions in the well bore and weight must be set down on the test string for a short period of time in order to push the test string past these obstructions. Also, once the test string is in its desired location, various tools located below the formation tester valve, such as for example the packer, often are designed to be actuated by setting weight on the test string.

Thus, it has been found desirable to provide such formation tester valves with a hydraulic time delay device which requires that sufficient weight be set down on the formation tester valve for a sufficient period of time, on the order of several minutes, before the formation tester valve will actually open.

An early example of such a formation tester valve with a hydraulic time delay is shown in U.S. Pat. No. 2,740,479 to Schwegman.

In Schwegman, the hydraulic time delay is provided by metering fluid through a plurality of tiny annular orifices created between metering pins 42 and metering passageways within which the metering pins are closely received.

Another example of a formation tester valve utilizing a hydraulic time delay is shown in U.S. Pat. No. 3,814,182 to Giroux, which in FIG. 10 thereof illustrates its hydraulic time delay device which meters fluid through a conically shaped annular passage defined between spaced conically tapered surfaces 124 and 125.

Also, it is well known in the prior art to utilize hydraulic impedance devices constructed by placing a fluid flow restricting orifice in a passageway between two fluid chambers. Examples of such devices are seen in U.S. Pat. No. 4,417,622 to Hyde, U.S. Pat. No. 3,664,415 to Wray et al., U.S. Pat. No. 4,113,012 to Evans et al., and U.S. Pat. No. 4,346,770 to Beck.

SUMMARY OF THE INVENTION

The present invention provides a well tool apparatus having an improved hydraulic impedance system for impeding telescoping motion between a housing and a mandrel of the apparatus.

The apparatus of the present invention includes a housing adapted to be connected in a pipe string. A mandrel means is slidably received in the housing and adapted to be selectively telescoped between first and second positions relative to the housing to manipulate an operating assembly of the apparatus, which in the disclosed embodiment is a spherical valve member of a tester valve.

The mandrel is spaced radially inward from the housing to define a longitudinally extending annular metering chamber therebetween. The metering cartridge is disposed in this metering chamber and divides the metering chamber into first and second portions. The metering cartridge has fluid flow passage means disposed therethrough joining the first and second portions of the metering chamber, and has fluid flow impedance means disposed in the fluid passage means.

A sliding seal is provided between the metering cartridge and the housing.

A selective sealing means is provided for temporarily sealing between the metering cartridge and the mandrel means. The selective sealing means seals between the metering cartridge and the mandrel means when the mandrel means slides in a first direction relative to the housing means, thus requiring any fluid flow between the upper and lower portions of the metering chamber to be through the fluid flow passage means of the metering cartridge. The selective sealing means allows fluid flow between the portions of the metering chambers to bypass the fluid passage means of the chamber when the mandrel slides in a second direction relative to the housing means.

The metering cartridge is slidably disposed about the mandrel means, and is slidable relative to the mandrel means between upper and lower limits.

The selective sealing means seals between the metering cartridge and the mandrel means when the metering cartridge is at its lower limit relative to the mandrel means, and allows fluid to bypass the metering cartridge when the metering cartridge is at its upper limit relative to the mandrel means.

Numerous objects, features and advantages of the present invention will be readily apparent to those skilled in the art upon a reading of the following disclosure when taken in conjunction with the accompanying drawings.

DETAILED DESCRIPTION OF THE PREFERRED EMBODIMENT

The Housing Means

Figure 1A:
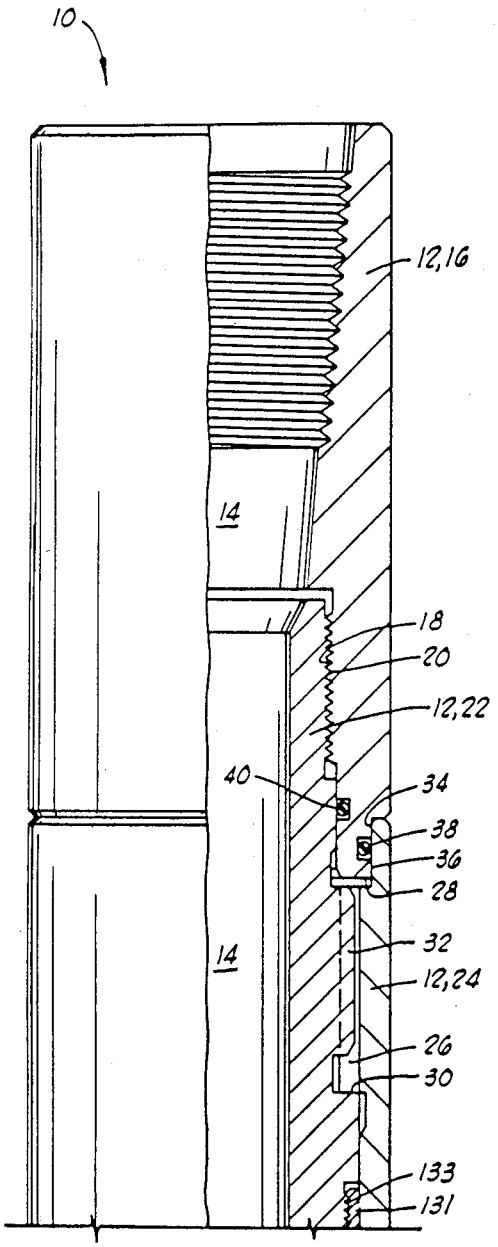
FIGS. 1A–1F comprise an elevation right side only sectioned view of a well tester tool embodying the present invention.

Referring now to the drawings, and particular to FIGS. 1A–1F, the well testing tool of the present invention is shown and generally designated by the numeral 10.

The tool 10 includes a housing means generally designated by the numeral 12 which is adapted to be connected in a well test string (not shown) and which has a substantially open bore 14 therethrough.

The housing means 12 includes a number of generally cylindrically shaped tubular elements threadedly connected together as illustrated in the drawings.

Housing means 12 includes an upper adaptor 16 having a lower internal threaded surface 18 threadedly engaged with an external threaded surface 20 of an upper end of upper inner housing mandrel 22.

Housing 12 further includes an outer case 24, the upper portion of which is concentrically received about a lower portion of upper inner housing mandrel 22 which extends below upper adapter 16.

Outer case 24 includes a plurality of radially inwardly directed splines 26 which are longitudinally held between a lower end 28 of upper adapter 16 and an upwardly facing annular shoulder 30 of upper inner housing mandrel 22. The splines 26 mesh with a plurality of radially outwardly directed splines 32 of upper inner housing mandrel 22 to prevent relative rotation therebetween.

An uppermost end of case 24 above splines 26 has a cylindrical inner surface 34 which is closely received about a cylindrical outer surface 36 of upper adapter 16, with a seal being provided therebetween by resilient O-ring seal means 38.

A seal is provided between upper inner housing mandrel 22 and upper adapter 16 by resilient O-ring seal 40.

Case 24 has an internally threaded cylindrical surface 42 near its lower end which is threadedly connected to an externally threaded cylindrical surface 44 of an upper portion of an intermediate housing adapter 46 of housing means 12. A seal is provided therebetween by resilient O-ring seal 48. Intermediate housing adapter 46 can generally be referred to as a lower housing section 46 in relation to the outer case 24 of housing means 12.

Intermediate housing adapter 46 includes a threaded inner cylindrical surface 50 which is threadedly connected to a threaded outer cylindrical surface 52 which is located near an upper end of a relief chamber case 47 of housing means 12, with a seal being provided therebetween by resilient O-ring 49. Relief chamber case 47 has a relief port 45 disposed through a wall thereof.

Relief chamber case 47 has an internal threaded cylindrical surface 51 near its lower end which is threadedly connected to an external threaded surface 53 located near an upper end of an upper fill port adapter 55 of housing means 12.

Upper fill port adapter 55 has an upper fill port 57 disposed through a wall thereof which is closed by a sealed threaded plug 59.

Upper fill port adapter 55 has an external threaded cylindrical surface 61 near its lower end which is threadedly connected to an internal threaded cylindrical surface 63 located near an upper end of a metering chamber case 65 of housing means 12 with a seal being provided therebetween by resilient O-ring 67.

Metering chamber case 65 has an internal threaded cylindrical surface 69 near its lower end which is threadedly connected to an external threaded cylindrical surface 71 of a lower fill port adapter 73, with a seal being provided therebetween by a resilient O-ring seal 75.

Lower fill port adapter 73 has a lower fill port 56 disposed radially through a wall thereof, which is sealed by a threaded seal plug 58.

Lower fill port adapter 73 has an external threaded surface 60 near a lower end thereof which is threadedly connected to an internal threaded surface 62 located near an upper end of lower housing case 64 of housing means 12, with a seal being provided therebetween by resilient O-ring seal 66.

Lower housing case 64 has an annulus fluid port 68 disposed through a wall thereof. Lower case 64 further includes a threaded inner cylindrical surface 70 near its lower end which is threadedly connected with a threaded external surface 72 near the upper end of a bypass sleeve actuating ring 74 of housing means 12. The bypasss sleeve actuating ring 74 has a vertical vent passage 76 disposed longitudinally therethrough.

The Valve Assembly and Valve Support Structure

Disposed within the outer case 24 of housing means 12 is a valve assembly 78 (see FIG. 1B) which includes a spherical valve member 80 having a substantially open valve bore 82 therethrough. Valve assembly 78 further includes upper and lower annular seats 84 and 86 which engage the spherical valve member 80.

Figure 1B:
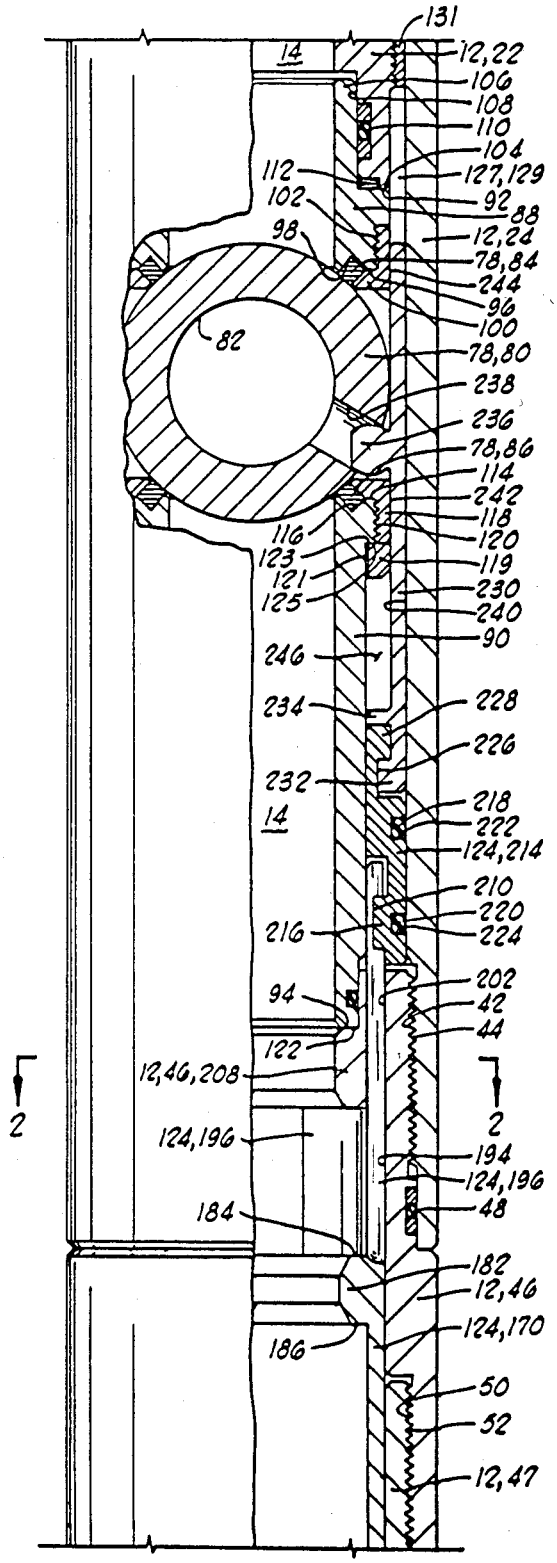
Figure 1:
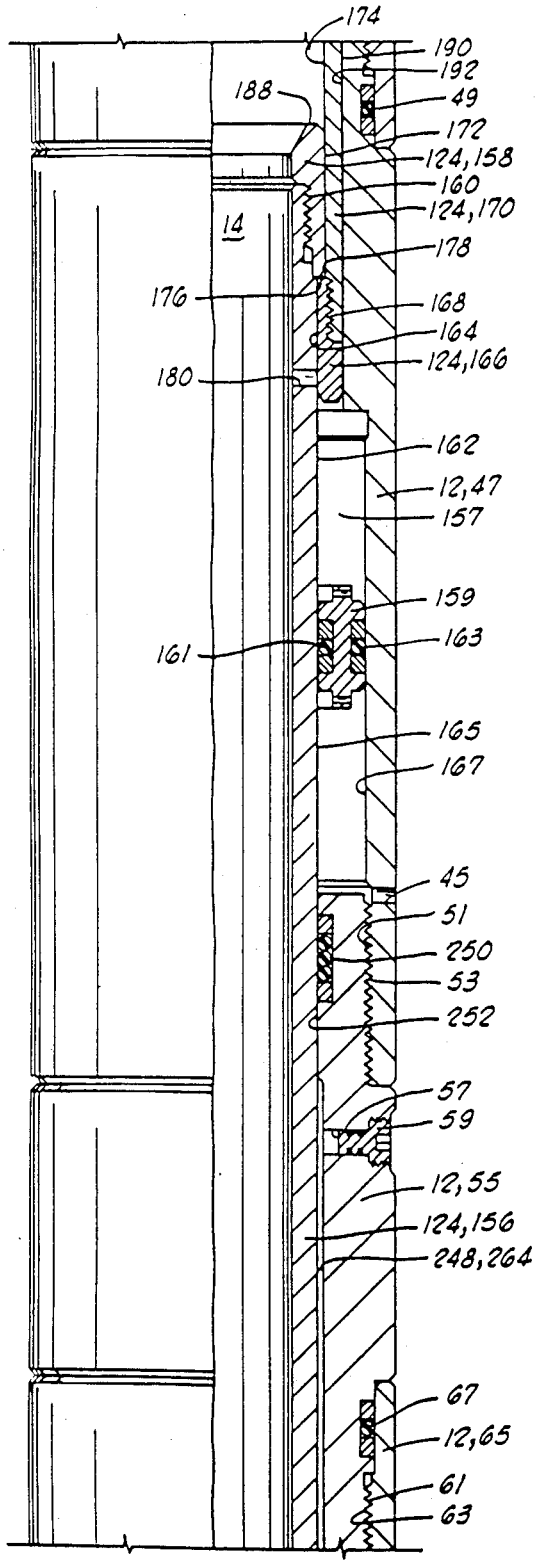
Figure 1:
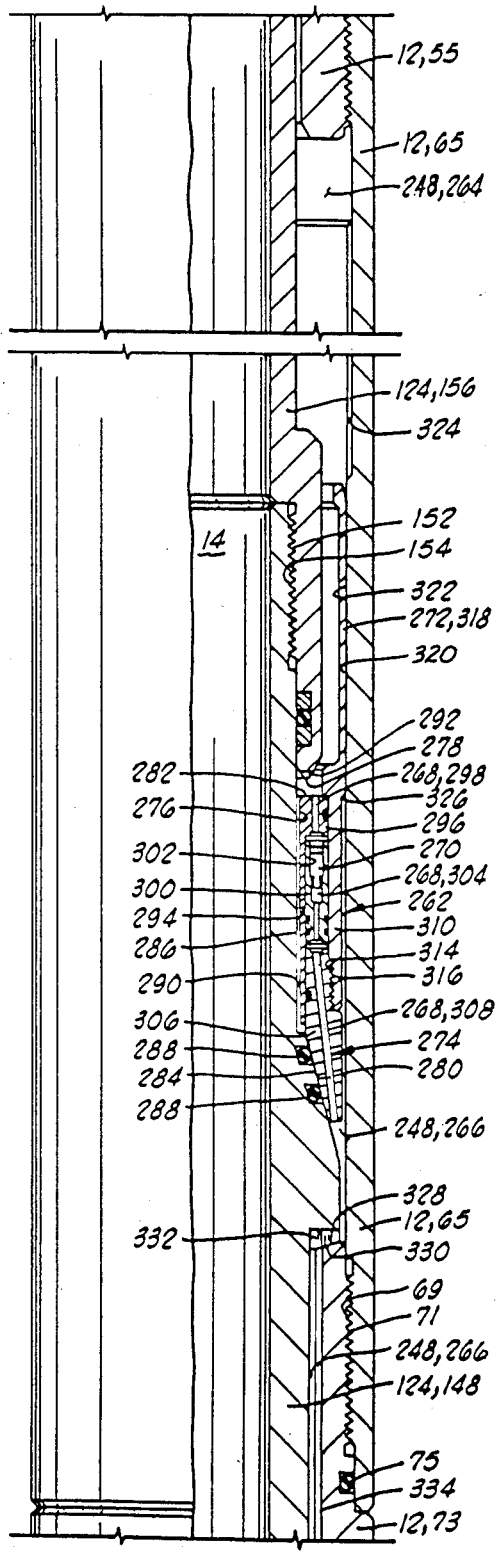

The spherical valve member 80 is rotatable within the seats 84 and 86 between a closed position illustrated in FIG. 1B wherein the spherical valve member closes the housing bore 14, and an open position wherein the spherical valve member is rotated to a position wherein valve bore 82 is aligned with housing bore 14.

An upper load transfer mandrel 88 is disposed between upper annular seat 84 and housing means 12 for transferring an upward force caused by an upwardly directed pressure differential across the spherical valve member 80 to the housing means 12 by compressional loading of the upper load transfer mandrel.

Similarly, a lower load transfer mandrel 90 is disposed between lower annular seat 86 and intermediate housing adapter 46 of housing means 12 for transferring a downward force caused by a downwardly directed pressure differential across the spherical valve member 80 to the housing means 12 by compressional loading of the lower load transfer mandrel 90.

Upper inner housing mandrel 22 of housing means 12 includes an internal downwardly facing upper support shoulder 92 located above spherical valve member 80, and intermediate housing adapter 46 includes an internal upwardly facing lower support shoulder 94 located below spherical valve member 80.

The upper load transfer mandrel 88 has a lower end 96 receiving upper annular seat 84 in an annular groove 98 thereof. Upper seat 84 is held in place in groove 98 by an annular retaining ring 100 threadedly connected to upper load transfer mandrel 88 at threaded connection 102.

The upper annular seat 84 is turned on an angle as seen in FIG. 1B and is captured in groove 98 by retaining ring 100 in order to hold the resilient seat 84 in place when the spherical valve member 80 is open and fluid is flowing at high flow rates through bore 14. This prevents seat 84 from being washed out of groove 98 by the rapidly flowing fluid.

Upper load transfer mandrel 88 further includes an upper end 104 adapted to engage the downwardly facing upper support shoulder 92 of housing means 12, so that the upward force caused by any upward pressure differential across spherical valve member 80 is transferred by compression of the upper load transfer mandrel between upper support shoulder 92 and upper annular seat 84.

Upper load transfer mandrel 88 includes an upper annular extension 106 closely received in a lower inner cylindrical bore 108 of upper inner housing mandrel 22, with a seal being provided therebetween by resilient O-ring seal means 110.

A resilient biasing spring 112, which preferably is a Belleville-type spring, is compressed between upper end 104 of upper load transfer mandrel 88 and upper inner housing mandrel 22 so as to provide a downward resilient biasing force against upper load transfer mandrel 88 and thus against upper annular seat 84.

As will be understood by those skilled in the art, when utilizing resilient annular seats such as upper and lower seats 84 and 86, provision must be made for a slight longitudinal movement of spherical valve member 80 relative to the resilient seats, and this is provided by the two Belleville springs designated as 112.

The Belleville springs 112 also assist in the sealing of spherical valve member 80 against upper resilient seat 84. The downward biasing force of springs 112 on upper load transfer mandrel 88 provides enough compression of upper resilient seat 84 against spherical valve member 80 to provide an initial shutoff of fluid flow therebetween.

Then the main sealing force is provided by a downward pressure differential acting on upper load transfer mandrel 88. This downward pressure differential acts on an annular differential area of upper load transfer mandrel 88 defined between annular seal 110 and the line of effective sealing engagement of upper annular seat 84 against spherical valve member 80.

A ratio of the circular area within seal 110 to the circular area within the line of effective sealing engagement of upper annular seat 84 is preferably in the range of about 1.20 to 1.30. Ratios greater than about 1.30 are generally impractical because the frictional forces between seat 84 and spherical valve member 80 would be so great that too much force would be required to rotate spherical valve member 80.

The lower load transfer mandrel 90 includes an upper end 114 receiving lower annular seat 86 in a groove 116 thereof.

Resilient annular seat 86 is held in place within groove 116 by a retaining ring 118 threadedly connected to lower load transfer mandrel 90 at threaded connection 120.

The lower load transfer mandrel 90, lower retaining ring 118, lower annular seat 86, spherical valve member 80, upper annular seat 84, upper retaining ring 100, and upper load transfer mandrel 88 are held together by a cylindrical valve retaining cage 119. The cage 119 has a bore 121 through its lower end, through which the second load transfer mandrel 90 is received.

Cage 119 further includes an upward facing shoulder 123 which abuts a downward facing shoulder 125 of lower load transfer mandrel 90.

Cage 119 includes an intermediate cylindrical cage portion 127 surrounding spherical valve member 80 and having a pair of longitudinally extending recesses 129 in an exterior surface thereof for slidably receiving a pair of actuating arms 230 as is further described below.

Cage 119 also includes an upper end 131 which is threadedly connected to upper inner housing mandrel 22 of housing means 12 at threaded connection 133.

Lower load transfer mandrel 90 has a lower end 122 adapted to engage lower support shoulder 94 of intermediate housing adapter 46 of housing means 12, so that downward forces caused by a downward pressure differential across spherical valve member 80 are transferred by compression of lower load transfer mandrel 90 between lower support shoulder 94 and lower annular seat 86.

The Mandrel Means

A mandrel means 124 is generally slidably received within housing means 12 and is adapted to be selectively telescoped between first and second positions relative to housing means 12 to rotate the spherical valve member 80 between its closed and open positions.

Mandrel means 124 includes a lower adapter 126 (see FIG. 1F) having a lower external threaded pin end 128 for connection thereof to a conventional pipe string or some adjacent tool such as a packer which may be located below the well testing tool 10.

As seen in FIGS. 1B–1F, the longitudinal bore 14, which may also be referred to as a flow passage 14, extends through the various members of the mandrel means 124.

Disposed in lower adapter 126 is a lateral sample port 130 which is closed by a threaded plug 132. Sample port 130 and plug 132 are used for a variety of purposes such as to remove a sample from within the bore 14 after the tool 10 is removed from a well, or also to relieve excess pressure from within the bore 14 prior to disassembly of the tool 10.

Lower adapter 126 has an internal threaded surface 134 threadedly connected to an external threaded surface 136 located on a lower end of a bypass port adapter 138 of mandrel means 124, with a seal being provided therebetween by resilient O-ring 140.

One or more radial bypass ports 142 are disposed through the wall of bypass port adapter 138.

Bypass port adapter 138 has an internal threaded surface 144 near its upper end which is threadedly connected to an external threaded surface 146 located near a lower end of a lower power mandrel 148 of mandrel means 124 with a seal being provided therebetween by resilient O-ring 150.

Lower power mandrel 148 has an external threaded surface 152 near its upper end which is threadedly connected to an internal threaded surface 154 located near a lower end of an upper power mandrel 156 of mandrel means 124.

Upper power mandrel 156 is spaced radially inward from relief chamber case 47 of housing means 12 to define an annular relief chamber 157. An annular floating shoe 159 is disposed in relief chamber 157 and has annular inner and outer seals 161 and 163 which provide a sliding seal against cylindrical outer surface 165 of upper power mandrel 156 and cylindrical inner surface 167 of relief chamber case 47, respectively.

The lower end of annular shoe 159 is communicated with well annulus fluid through relief port 45.

Floating shoe 159 floats within relief chamber 157 to prevent hydraulic lock-up of mandrel means 124 relative to housing means 12 during telescoping movement therebetween.

A power mandrel retaining cap 158 is threadedly connected at 160 to an upper end of upper power mandrel 156.

An outer cylindrical surface 162 of upper power mandrel 156 is closely received within an inner cylindrical surface 164 of an actuating mandrel retaining cap 166.

Actuating mandrel retaining cap 166 is threadedly connected at threaded connection 168 to a lower end of an actuating mandrel 170 of mandrel means 124.

An outer cylindrical surface 172 of power mandrel retaining cap 158 is closely and slidably received within an inner cylindrical surface 174 of actuating mandrel 170.

Thus, relative sliding movement is allowed between upper power mandrel 156 and actuating mandrel 170. Downward movement of upper power mandrel 156 relative to actuating mandrel 170 is limited by engagement of a lower end 176 of power mandrel retaining cap 158 with an upper end 178 of actuating mandrel retaining cap 166.

Upper power mandrel 156 includes a relief port 180 disposed through a wall thereof to help prevent hydraulic lock-up as upper power mandrel 156 moves relative to actuating mandrel 170.

Actuating mandrel 170 includes a radially inward extending ridge 182 having upper and lower shoulders 184 and 186 defined thereon.

Upward movement of upper power mandrel 156 relative to actuating mandrel 170 is limited by engagement of an upper end 188 of power mandrel retaining cap 158 with lower shoulder 186 of ridge 182.

Actuating mandrel 170 has a cylindrical outer surface 190 closely and slidably received within inner cylindrical surface 192 of relief chamber case 47 of housing means 12 and inner cylindrical surface 194 of intermediate housing adaptor 46 of housing means 12.

Figure 2:
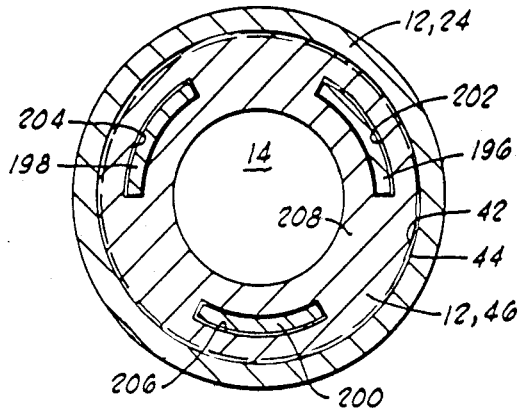
FIG. 2 is a section view along line 2—2 of FIG. 1B.

Extending longitudinally upward from actuating mandrel 170 are three 60° arcuate cross-section actuating fingers 196, 198 and 200 as seen in FIG. 1B and FIG. 2.

The actuating fingers 196, 198 and 200 extend upward through a plurality of corresponding arcuately shaped longitudinally extending actuating arm passageways 202, 204 and 206, respectively, which are disposed through a reduced internal diameter portion 208 of intermediate housing adapter 46 of housing means 12. As seen in FIG. 1B, the passageways 202, 204 and 206 are located radially outward of lower support shoulder 94 of intermediate housing adapter 46 of housing means 12.

The upper end portions of actuating fingers 196, 198 and 200 have arcuate grooves 210 therein.

A radially split actuating assembly collar 214 of mandrel means 124 has an annular radially inward extending flange 216 which is received within the grooves 210 of actuating fingers 196, 198 and 200. Preferably, the collar 214 is split into two 180° segments, which are placed about the upper ends of actuating fingers 196, 198 and 200 after they are inserted through the passageways 202, 204 and 206.

A pair of annular tension bands 218 and 220 are disposed in grooves 222 and 224 of collar 214 to hold the segments of collar 214 in place about the upper ends of actuating fingers 196, 198 and 200.

Collar 214 has an annular groove 226 disposed in its radially outer surface near the upper end thereof, and has a radially outward extending flange 228 located above groove 226.

A pair of actuating arms 230 (only one of which is shown) each has a lower radially inward extending flange 232 received within groove 226 of collar 214 and has an intermediate radially inward extending flange 234 located directly above radially outward extending flange 228 of collar 214 so that the flanges 228, 232 and 234 provide a longitudinal interlock between collar 214 and the actuating arms 230 so that actuating arms 230 move longitudinally with collar 214.

The actuating arms 230 are arcuate in cross section, and each has a radially inward extending lug 236 engaging an eccentric bore 238 of spherical valve member 80.

The arcuate actuating arms 230 are closely received between an inner cylindrical surface 240 of outer case 24 and outer cylindrical surfaces 242 and 244 of lower retaining ring 118 and upper retaining ring 100, and are disposed in longitudinally extending recesses 129 of the cylindrical valve retaining cage 119 previously described.

The lower portion of actuating arms 230, and the collar 214 are located in an annular cavity 246 which is defined between lower load transfer mandrel 90 and outer case 24 of housing means 12.

The actuating arms 230 with their lugs 236, along with collar 214 and actuating fingers 196, 198 and 200 may collectively be described as an elongated actuating arm assembly extending longitudinally from spherical valve member 80 through annular cavity 246 then through actuating means passageways 202, 204 and 206 to the actuating mandrel 170.

The Hydraulic Time Delay

Figure 3:
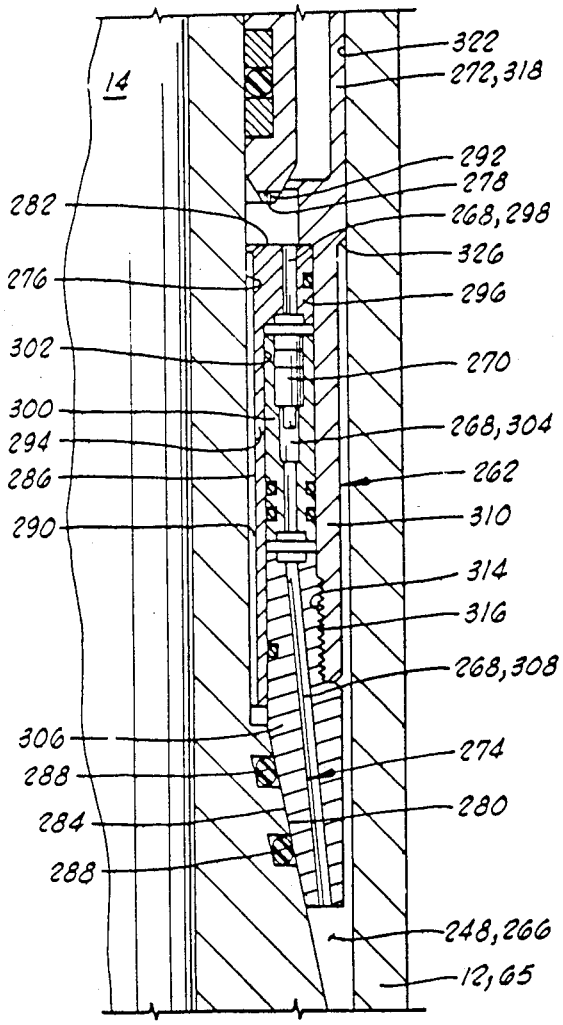
FIG. 3 is an enlarged view of the metering cartridge and surrounding structure of FIG. 1B.

Referring now to FIG. 1D and FIG. 3, those portions of tool 10 there illustrated, which provide a time delay function to the tool 10, will now be described in detail.

The upper power mandrel 156 and lower power mandrel 148 are spaced radially inward from housing means 12 along a substantial portion of their lengths to define an irregular annular cavity 248 which may be referred to as a metering chamber 248.

An upper extent of metering chamber 248 is defined by a plurality of resilient O-ring seals 250 (see FIG. 1C) which seal between cylindrical outer surface 165 of upper power mandrel 156 and a cylindrical inner surface 252 of upper fill port adapter 55.

A lower extent of metering chamber 248 is defined by a second annular floating shoe 254 which is received within an annular cavity 256 defined between lower power mandrel 148 and lower housing case 64.

Second floating shoe 254 includes radially inner and outer seals 255 and 257 which provide a sliding seal against cylindrical outer surface 258 of lower power mandrel 148 and cylindrical inner surface 260 of lower housing case 64, respectively.

The metering chamber 248 between its upper extremity at seals 250 and its lower extremity at second floating shoe 254 is filled with a metering fluid such as silicone oil.

An annular metering cartridge 262 is disposed in annular cavity 248, and is particularly located between lower power mandrel 148 and metering chamber case 65. Metering cartridge 262 generally divides metering chamber 248 into upper and lower metering chamber portions 264 and 266, respectively.

Metering cartridge 262 has a fluid passage means 268 disposed therethrough joining the upper and lower metering chamber portions 264 and 266. A fluid flow impedance means 270 is disposed in fluid passage means 268.

An outer sliding seal means 272 is provided for sealing between metering cartridge 262 and metering chamber case 65 of housing means 12.

A selective inner seal means 274 is provided for temporarily sealing between metering cartridge 262 and lower power mandrel 148 of mandrel means 124 when the mandrel means 124 slides upward relative to housing means 12, thus requiring any fluid flow between the upper and lower metering chamber portions 264 and 266 during such relative upward movement to be through said fluid passage means 268 of metering cartridge 262.

The selective sealing means 274 also allows fluid flow between upper and lower metering chamber portions 264 and 266 to bypass the fluid passage means 268 of cartridge 262 when lower power mandrel 148 of mandrel means 124 slides in a downward direction relative to housing means 12.

The metering cartridge 262 is slidably and concentrically disposed about an outer cylindrical surface 276 of lower power mandrel 148.

An upper stop shoulder 278 is defined on a lower end of upper power mandrel 156 of mandrel means 124 and may generally be described as extending radially outward from the cylindrical outer surface 276 of lower power mandrel 148 of mandrel means 124.

A lower stop shoulder 280 is defined on lower power mandrel 148 of mandrel means 124 and may generally be described as extending radially outward from cylindrical outer surface 276 of lower power mandrel 148 of mandrel means 124.

The metering cartridge 262 has upper and lower abutment shoulders 282 and 284, respectively, each of which may generally be described as extending radially outward from a cylindrical inner surface 286 of metering cartridge 262.

A longitudinal distance between first and second abutment shoulders 282 and 284 is sufficiently less than a longitudinal distance between first and second stop shoulders 278 and 280 of mandrel means 124 so that the metering cartridge 262 can slide out of engagement with either of the stop shoulders 278 or 280 of mandrel means 124.

The lower stop shoulder 280 of lower power mandrel 148 is a conically tapered outer surface of lower power mandrel 148, and said tapered outer surface diverges away from the outer cylindrical surface 276 of lower power mandrel 148.

The lower abutment shoulder 284 of metering cartridge 262 is an internal conically tapered surface which is so constructed as to closely fit about and engage the tapered outer surface 280 of lower power mandrel 148.

When the conically tapered surfaces 280 and 284 are in engagement as seen in FIG. 1D and FIG. 3, a fluid-tight seal is provided therebetween by a pair of resilient O-ring seals 288 disposed in annular grooves in the tapered outer surface 280 of lower power mandrel 148.

The internal cylindrical surface 286 of metering cartridge 262 has an inside diameter greater than an outside diameter of cylindrical outer surface 276 of lower power mandrel 148, thus defining an annular bypass passage 290 between lower power mandrel 148 and metering cartridge 262.

During downward movement of lower power mandrel 148 relative to metering chamber case 65 of housing means 12, the outer tapered surface 280 of lower power mandrel 148 will move downward relative to and out of engagement with the inner conically tapered surface 284 of metering chamber 262 so that the metering fluid contained in metering chamber 248 bypasses fluid flow passage 268.

When the fluid bypasses fluid passage means 268, it flows upward between tapered surfaces 280 and 284, then through annular bypass passage 290, and then between upper abutment shoulder 282 of metering cartridge 262 and upper stop shoulder 278 of upper power mandrel 156 of mandrel means 124.

A plurality of recesses 292 are disposed in upper stop shoulder 278 to permit this fluid bypass flow even when upper stop shoulder 278 is engaged with upper abutment shoulder 282.

The metering cartridge 262 includes an inner barrel 294 having said cylindrical inner surface 286 of metering cartridge 262 defined thereon, and having an enlarged outside diameter portion 296 near an upper end thereof which in turn has the first abutment shoulder 282 defined thereon. Inner barrel 294 includes an inlet portion 298 of fluid passage means 268 disposed through said enlarged diameter portion 296 thereof.

Metering cartridge 262 further includes an annular flow restricter ring 300 which is closely and slidably received about a cylindrical outer surface 302 of inner barrel 294, and which has a central portion 304 of fluid passage means 268 disposed therethrough.

Metering cartridge 262 further includes an annular outlet ring 306 closely received about said cylindrical outer surface 302 of inner barrel 294 adjacent a lower end thereof. The outlet ring 306 has the conically tapered inner surface 284 defined thereon, and has an outlet portion 308 of fluid passage means 268 disposed therethrough.

Metering cartridge 262 also includes an outer barrel 310 concentrically disposed about the enlarged diameter portion 296 of inner barrel 294, the flow restricter ring 300, and the outlet ring 306. Outer barrel 310 has a radially inward extending shoulder 312 engaging the upper end 282 of inner barrel 294, and has an internally threaded surface 314 at its lower end which threadedly engages a threaded outer surface 316 of outlet ring 306 to thereby fixedly hold the inner barrel 294, flow restricter ring 300, outlet ring 306 and outer barrel 310 together.

The outer sliding seal means 272 of metering cartridge 262 includes a cylindrical extensible barrel 318 which is integrally formed with and extends longitudinally upward from outer barrel 310. Extensible barrel 318 has a cylindrical outer surface 320 which slidingly and sealingly engages a cylindrical inner surface 322 of metering chamber case 65 of housing means 12.

The extensible barrel 318 is open at its upper end so that when metering cartridge 262 and mandrel means 124 slide upward relative to housing means 12, the extensible barrel expands slightly to provide a fluid-tight seal between its cylindrical outer surface 320 and the cylindrical inner surface 322 of housing means 12. As will be understood by those skilled in the art, outer surface 320 of extensible barrel 318 and inner surface 322 of metering chamber case 65 are finely honed to provide this fluid-tight fit.

The operation of metering cartridge 262 is generally as follows. The well testing tool 10 is illustrated in FIGS. 1A–1F in the initial telescopingly extended position in which it would normally be run into a well. In this initial position, the spherical ball valve means 82 is closed.

To open the spherical ball valve means 80, weight is set down on the pipe string to which the tool 10 is connected.

The metering cartridge 262 provides a time delay between the time at which weight is initially set down on the pipe string, and the time when the spherical valve member 80 is actually rotated to its open position. This time delay is preferably on the order of three to four minutes.

This time delay is necessary in order to prevent premature opening of the spherical valve member 80 when the testing string is being lowered into the well and periodically encounters obstructions and the like. Also, it prevents premature closing of the bypass port 142. Also, often other tools located below the tester valve 10 must also be actuated with a reciprocating motion, and it is desirable to be able to actuate those tools without actuating the tester valve 10.

This time delay is accomplished in the following manner.

Normally in the use of the tester valve 10, it is located directly above a packer means (not shown). When the tester valve 10 has been lowered to its desired position within a well, the packer means loacted therebelow is normally set against the inner surface of the well, so that the lower adapter 126 of mandrel means 124 is then fixed relative to the well.

Then, to actuate the tester valve 10, weight is set down on the pipe string thereabove. This causes the housing means 12 to begin to move downward relative to the mandrel means 124. As this relative motion occurs, the metering fluid contained in the upper portion 264 of metering chamber 248 is pressurized.

This relative downward motion of housing means 12 relative to mandrel means 124 causes the conically tapered inner surface 284 of metering cartridge 262 to seal against the resilient seals 288, and the increased pressure in upper portion 264 of metering chamber 248 causes the extensible barrel 318 to swell and seal tightly against metering chamber case 65, so that the only passage for flow of metering fluid from upper metering chamber portion 264 is through the fluid passage means 268 of metering cartridge 262.

Flow through the fluid passage means 268 is restricted by the fluid flow impedance means 270, so that the relative downward movement of housing means 12 relative to mandrel means 124 is impeded.

Thus, initially, housing means 12 moves downward only at a very slow rate relative to mandrel means 124. This slow movement continues until a plurality of longitudinally extending recesses 324 disposed in cylindrical inner surface 322 of metering chamber case 65 reach a position below a lower end 326 of extensible barrel 318 at which point the seal between extensible barrel 318 and metering chamber case 65 is broken thus allowing metering fluid to bypass from upper metering chamber portion 264 through recesses 324 around the outside of metering cartridge 262 to the lower metering chamber portion 266, which allows the final portion of the downward movement of housing means 12 relative to mandrel means 124 to occur very rapidly. This rapid movement quickly opens the spherical valve member 80, and provides an indication at the surface that the tester valve 10 is open.

The uppermost position of housing means 12 relative to mandrel means 124 is defined by engagement of an upper end 328 of lower fill port adapter 73 with a downward facing annular shoulder 330 of lower power mandrel 148. Downward facing shoulder 330 has a plurality of recesses 332 disposed therein to allow fluid flow between shoulder 330 and upper end 328 of lower fill port adapter 73.

Lower fill port adapter 73 includes a plurality of radially inward extending splines 334, which are engaged with a plurality of radially outward extending splines 336 of lower power mandrel 148 to prevent rotational movement therebetween.

The Run-In Bypass Port and Bypass Valve

Normally, the tester tool 10 is run into the well with the spherical valve member 80 in its closed position, and a packer (not shown) is located immediately below tool 10 and fits rather closely within the inner surface of the well. It is desirable to have a bypass means for allowing fluid in the flow passage 14 below the closed spherical valve member 80 to bypass the packer, thus preventing a piston-type effect opposing the downward motion of the test string into the well.

Bypass port adapter 138 of mandrel means 124 has a lateral bypass port 142 disposed therethrough which communicates the flow passage 14 with an exterior surface 338 of bypass port adapter 138 of mandrel means 124.

A reversible removable sliding sleeve 340 is concentrically and closely recieved about exterior surface 338 of bypass port adapter 138.

An upper end 342 of sliding sleeve 340 is engaged by a lower end 344 of bypass sleeve actuating ring 74 of housing means 12 when housing means 12 moves downward relative to actuating means 124. This causes sliding sleeve 340 to move downward with housing means 12 relative to mandrel means 124 so that sliding sleeve 340 closes bypass port 142 prior to the opening of the spherical valve member 80.

Upper and lower resilient O-ring seals 346 and 348 are provided between exterior surface 338 of bypass port adapter 138 and an inner cylindrical surface 350 of sliding sleeve 340.

Sliding sleeve 340 has a latch means 352 on its lower end. Latch means 352 includes a plurality of longitudinally extending collet spring fingers 354 having radially inward directed shoulders 356 thereon.

A latch engagement means 358 is defined on lower adapter 126 of mandrel means 124, and is an annular radially outward extending ridge arranged to be engaged by the spring collet fingers 354. The outer ends of the spring collet fingers 354 snap over the ridge 358 so that the shoulders 356 are located below ridge 358.

Figure 1E:
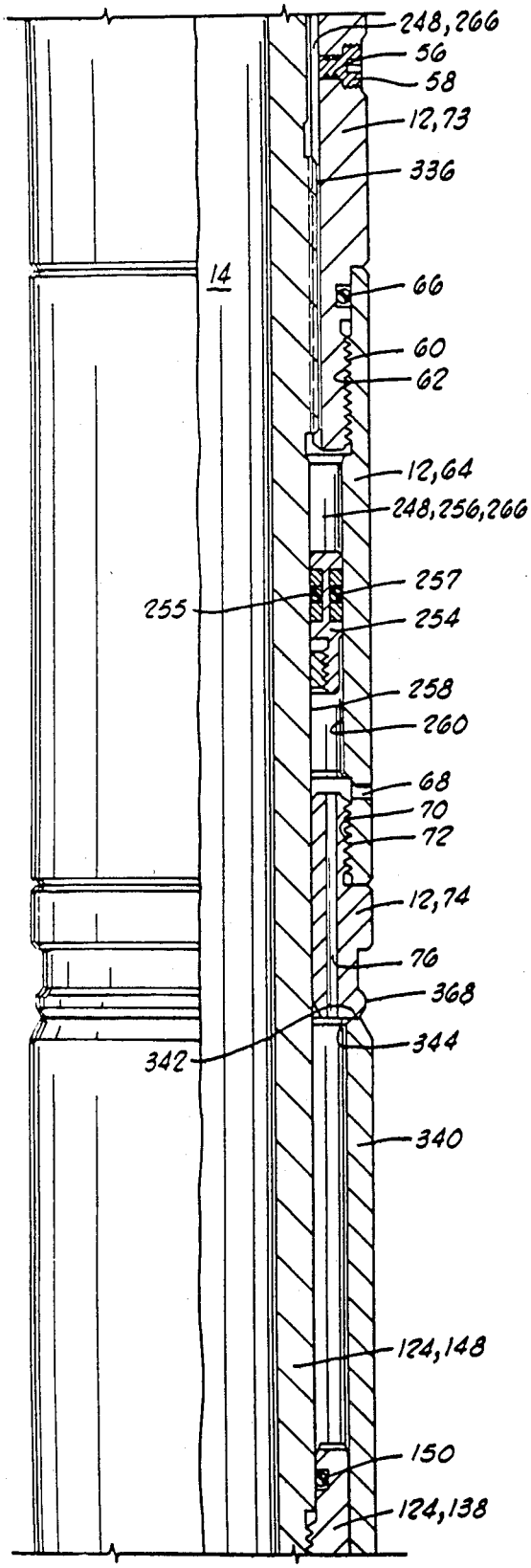
Figure 1F:
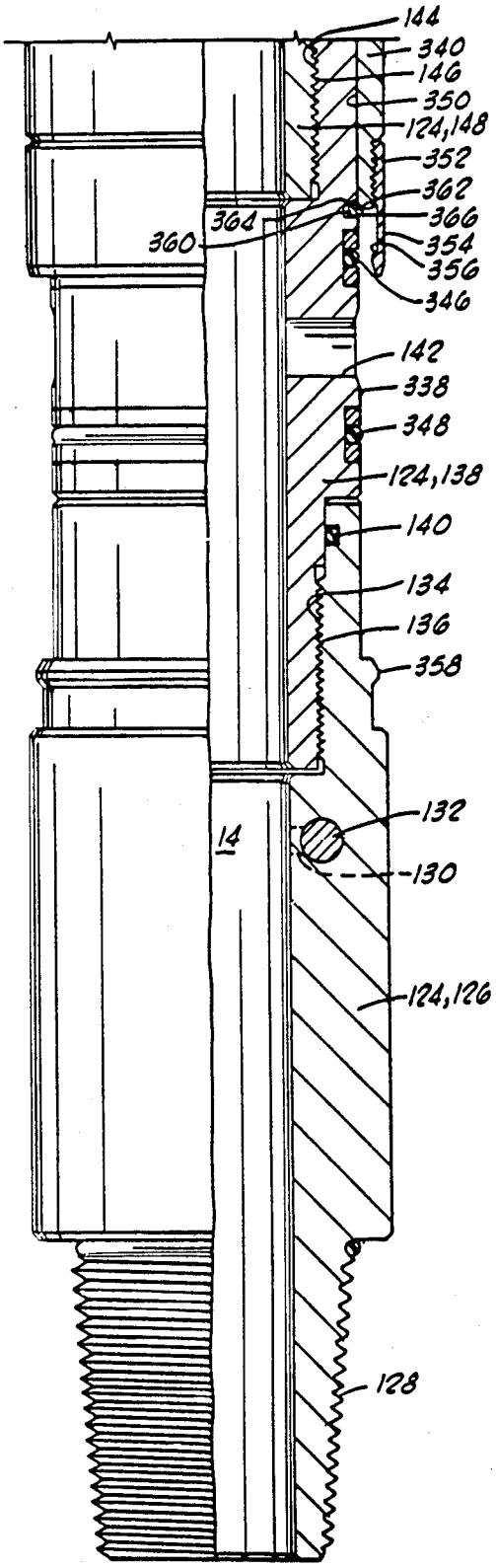

Initially, sliding sleeve 340 is held in its upward position illustrated in FIGS. 1E–1F by an inwardly resilient spring ring 360 having a radially outer tapered surface 362 thereon. As the sliding sleeve 340 begins its downward movement, a chamfered lower inner edge 364 thereof engages tapered outer surface 362 of spring ring 360 and cams spring ring 360 radially inward into the groove 366 disposed in the outer surface of bypass port adapter 138.

Thus, with the arrangement illustrated in FIGS. 1E–1F, the bypass port 142 is initially in its open position.

When housing means 12 is telescoped downwardly relative to adapter means 124, it pushes sliding sleeve 340 downward relative to mandrel means 124 until latch means 352 engages latch engagement means 358, at which time sliding sleeve 340 becomes fixedly attached to lower adapter 126 of mandrel means 124, with the bypass portion 142 closed.

Although the tool 10 can subsequently be telescopingly extended to reclose spherical valve member 80, the bypass port 142 will remain closed.

Figure 4E:
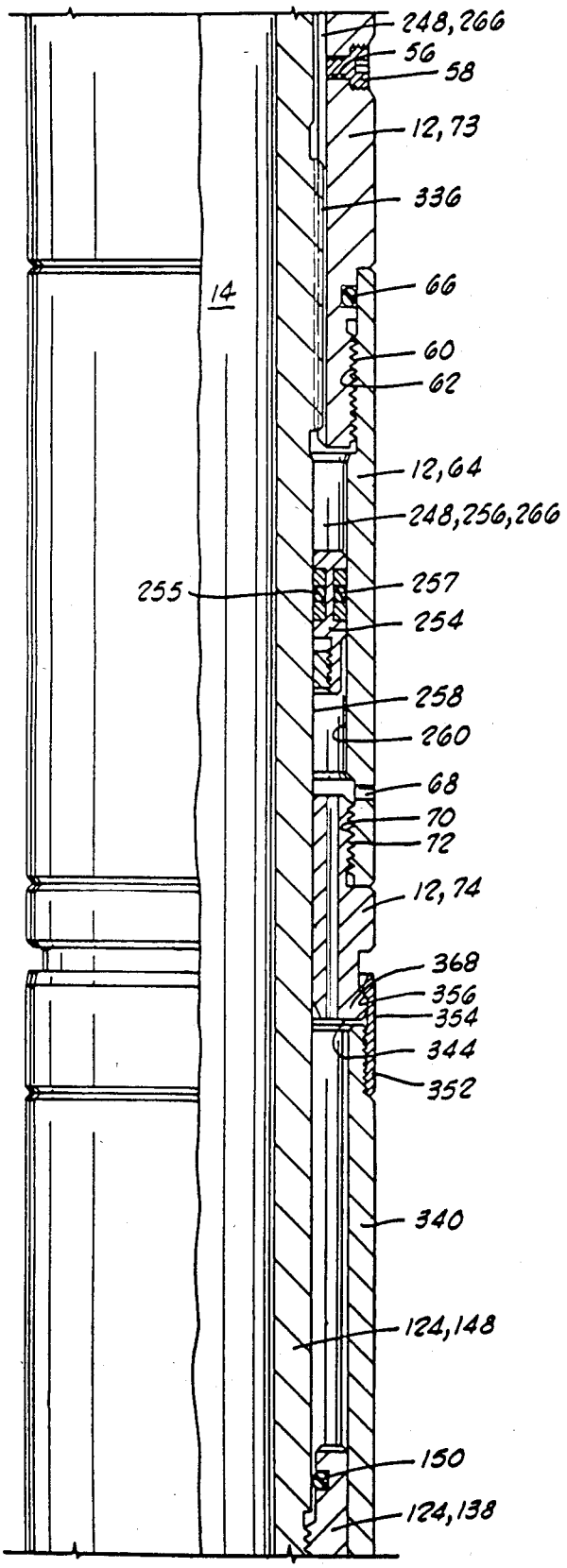
FIGS. 4E–4F are similar to FIGS. 1E–1F and illustrate an alternative arrangement of the sliding sleeve which operates with the bypass port.
Figure 4F:
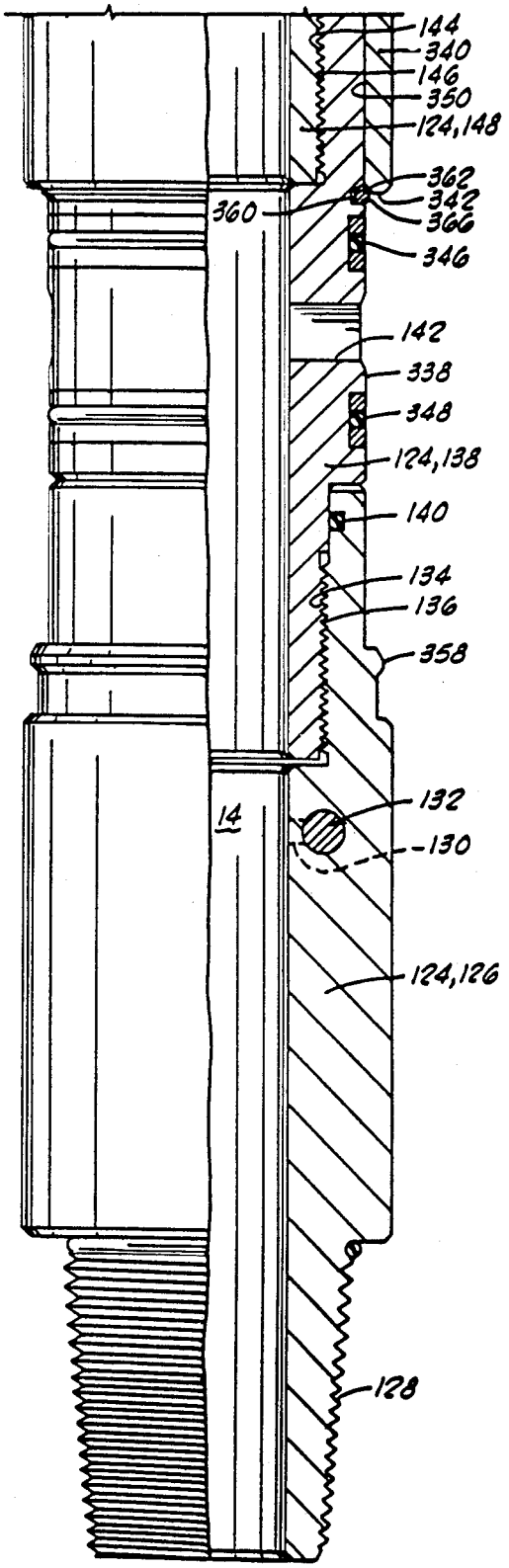

An alternative function of the bypass port 142 can be provided by longitudinally reversing the orientation of sliding sleeve 340 relative to the remainder of the tool 10 when the tool 10 is assembled, as is shown in FIGS. 4E–4F. In this reverse orientation, the latch means 352 is located at the upper end of the sliding sleeve 340, and is latched over a latch engagement means 368 of bypass sleeve actuating ring 74. The latch engagement means 368 is an annular radially outward extending ridge which is engaged by the spring collet fingers 354 of latch means 352 in a manner similar to that previously described for the latch engagement means 358 of lower adapter 126.

With this alternative arrangement of the sliding sleeve 340, the sliding sleeve 340 is always attached to the housing means 12 so that it always reciprocates upwardly or downwardly with housing means 12 relative to mandrel means 124.

Thus, with the alternative arrangement just described, the bypass port 142 can be repeatedly closed and opened by telescoping collapsing or extending, respectively, motion between the housing means 12 and mandrel means 124.

Figure 5E:
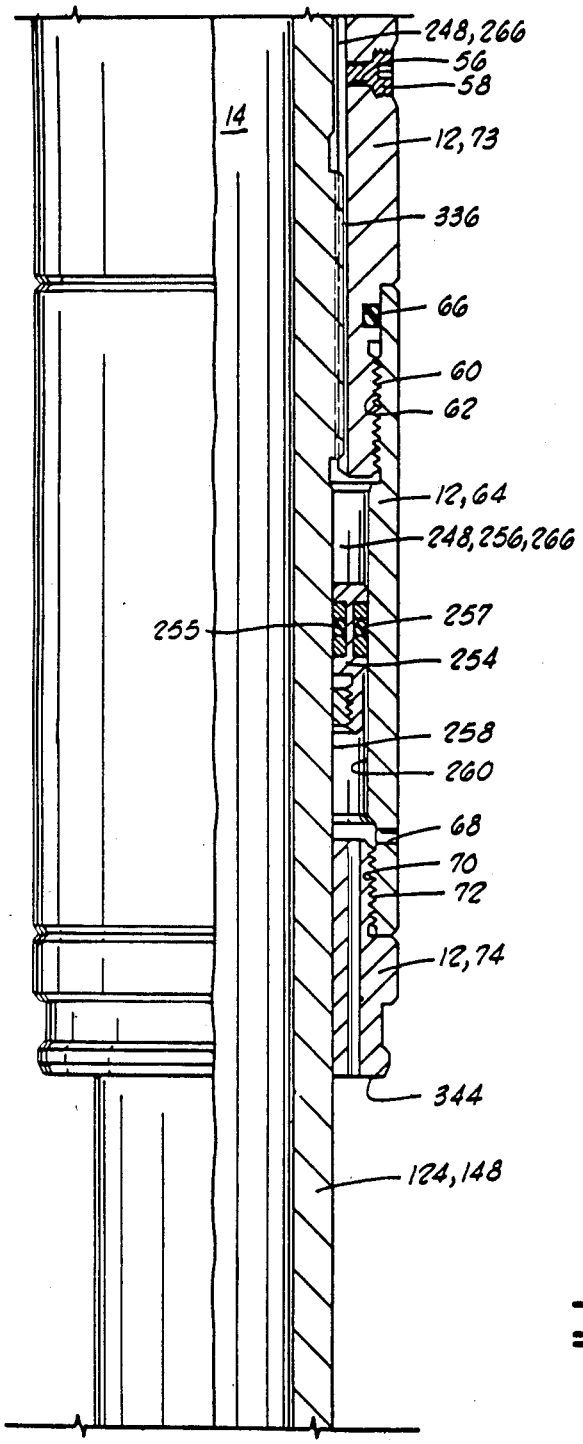
FIGS. 5E–5F are similar to FIGS. 1E–1F and illustrate another alternative arrangement wherein the bypass is completely eliminated.
Figure 5F:
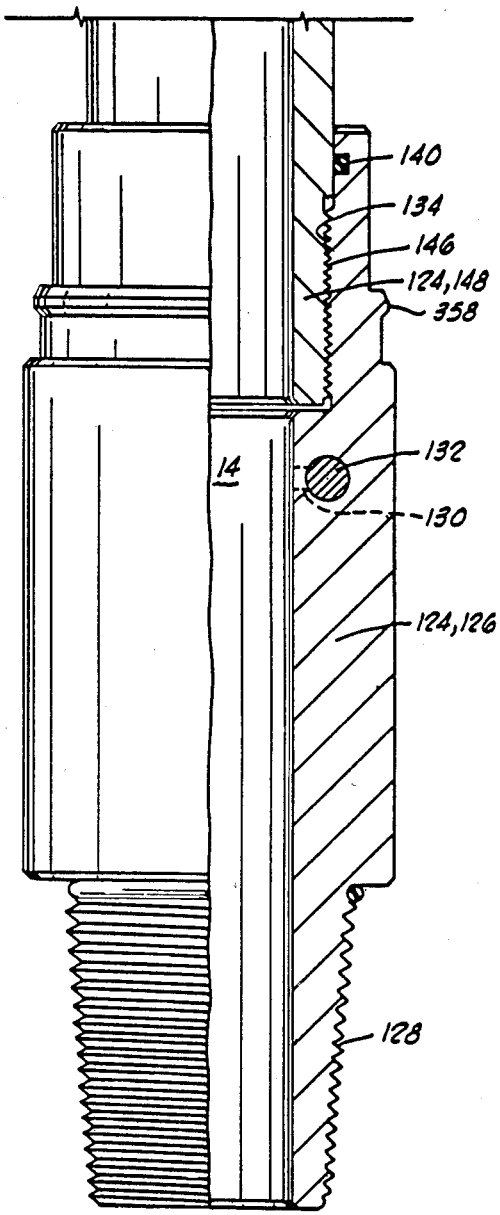

Another alternative is also provided by the structure shown in FIGS. 1E–1F, with regard to the use of the bypass port 142. This last alternative as illustrated in FIGS. 5E–5F provides a means for completely eliminating the bypass port 142.

This can be done because the external threaded surfaces 146 and 136 of lower power mandrel 148 and bypass port adapter 138, respectively, are substantially identical, and also the internal threaded surfaces 144 and 134 of bypass port adapter 138 and lower adapter 126 are substantially identical, so that the bypass port adapter 138 can be removed and the internal threaded surface 134 of lower adapter 126 may be threadedly connected to the external threaded surface 146 of lower power mandrel 148, to thus eliminate the bypass port 142. When the bypass port adapter 138 is removed, the sliding sleeve 340 is also entirely removed from the tool 10.

Summary Of The Operation Of The Tester Tool

As previously mentioned, the well tester tool 10 is generally assembled in a well test string having an annular packer located therebelow.

The test string is lowered to the desired location within a well, at which point the annular packer located below the tester tool 10 is set in place within the well, thus fixing the position of lower adapter 126 relative to the well.

Then when it is desired to open the spherical valve member 80 in order to test the well formation located below the packer means, weight of the pipe string is slacked off, which accordingly exerts a downward force on the housing means 12.

Downward movement of housing means 12 relative to mandrel means 124 is intially impeded by the action of metering cartridge 262.

During this period of slow movement, the sliding sleeve 340 is pushed downward to a position below lower annular seal 348 so that bypass port 142 is closed.

Subsequent to the closing of bypass port 142, the extensible barrel 318 of metering cartridge 262 passes the recesses 324 in metering chamber case 65 which then allows the housing means 12 to move rapidly downward relative to mandrel means 124.

The distance through which the housing means 12 travels relative to mandrel means 124 while metering fluid through metering cartridge 262 corresponds substantially to a longitudinal distance between upper end 188 of power mandrel retaining cap 158 and lower shoulder 186 of radially inner ridge 182 of actuating mandrel 170, so that during this slow downward movement of housing means 12, the actuating mandrel 170 moves slowly downward with housing means 12 until upper end 188 of power mandrel retaining cap 158 is approximately in engagement with lower surface 186 of ridge 182.

Then in the final rapid downward movement of housing means 12 relative to mandrel means 124, the housing means 12 also moves downward relative to actuating mandrel 170, collar 214, and actuating arms 230, so that the spherical valve member 80 is caused to be rotated to an open position. This final rapid movement of housing means 12 and of the pipe string attached thereabove jiggles the drill pipe at the surface thus providing a positive indication to personnel operating the well that the bypass is closed and the tester valve is open to begin the flow test of the hydrocarbon-producing zone of the well.

After the testing operation is completed, the spherical valve member 80 may be reclosed by picking up the weight of the pipe string and thus pulling the housing means 12 upwardly relative to the mandrel means 124.

As this upward movement of the housing 12 relative to mandrel means 124 begins, lower inner conically tapered surface 284 of metering cartridge 262 moves upward out of engagement with O-ring seals 288 so that metering fluid in the lower metering chamber portion 266 may bypass metering cartridge 262 and flow upward into upper metering chamber portion 264 to refill it as the volume of upper metering chamber portion 264 expands upon telescoping expansion of the tool 10.

When the tool 10 is fully extended, the parts thereof will once again be in the positions shown in FIGS. 1A–1F, except for the sliding sleeve, which will remain locked to the adapter 126.

Of course, if the sliding sleeve 340 is reversed as previously described with regard to FIGS. 4E–4F, so that the latch means 352 is permanently engaged with latch engagement means 368, the sliding sleeve 340 will move back upward with housing means 12 so as to reopen the bypass port 142.

Thus, it is seen that the apparatus of the present invention readily achieves the ends and advantages mentioned as well as those inherent therein. WHile certain preferred embodiments of the invention have been illustrated for the purposes of this disclosure, numerous changes in the arrangement and construction of parts may be made by those skilled in the art, which changes are embodied within the scope and spirit of the present invention as defined by the appended claims.

What is claimed is:

1. A well tool apparatus comprising:

housing means adapted to be connected in a pipe string;

mandrel means slidably received in said housing means and adapted to be selectively telescoped between first and second positions relative to said housing means to manipulate an operating assembly of said apparatus, said mandrel means being spaced radially inward from said housing means to define a longitudinally extending annular metering chamber therebetween, said mandrel means including:

first and second longitudinally spaced stop means, extending radially outward relative to said cylindrical outer surface of said mandrel means;

an annular metering cartridge disposed in said metering chamber and dividing said metering chamber into first and second portions, said metering cartridge having fluid passage means disposed therethrough joining said first and second portions, and having flow impedance means disposed in said fluid passage means, said metering cartridge being slidably and concentrically disposed about an outer cylindrical surface of said mandrel means and being longitudinally slidably received between the first and second longitudinally spaced stop means and engaging the first and second longitudinally spaced stop means of said mandrel means thereby limiting sliding movement of said metering cartridge relative to said mandrel means;

sliding seal means for sealing between said metering cartridge and said housing means; and selective sealing means for temporarily sealing between said metering cartridge and said mandrel means when said mandrel means slides in a first direction relative to said housing means thus requiring any fluid flow between said portions of said metering chamber to be through said fluid passage means of said cartridge, and for allowing fluid flow between said portions of said metering chamber to bypass said fluid passage means of said cartridge when said mandrel means slides in a second direction opposite said first direction relative to said housing means.

2. The apparatus of claim 1, wherein:

said sliding seal means comprises a cylindrical extensible barrel attached to said metering cartridge and extending in said first direction from an end of said metering cartridge, said extensible barrel having a cylindrical outer surface which slidingly and closely engages a cylindrical inner surface of said housing means, said extensible barrel being open at a free end thereof so that when said metering cartridge slides in said first direction relative to said housing means said extensible barrel expands to provide a fluid-tight seal between the cylindrical outer surface thereof and said cylindrical inner surface of said housing means.

3. The apparatus of claim 1, wherein:

said apparatus is further characterized as a well tester tool and said operating assembly thereof is a valve means for opening and closing a flow passage of said well tester tool in response to reciprocation of said pipe string; and said flow impedance means of said metering cartridge is further characterized as a means for providing a time delay between an initial application of longitudinal force to said pipe string and the operation of said valve means.

4. The apparatus of claim 1, wherein:

said second stop means includes a conically tapered outer surface of said mandrel means, said tapered outer surface diverging away from said outer cylindrical surface of said mandrel means; and said metering cartridge includes an inner conically tapered surface at an end of said cartridge adjacent said second stop means, said tapered inner surface being so constructed as to closely fit about and engage said tapered outer surface of said mandrel means.

5. The apparatus of claim 4, wherein:

said selective sealing means includes an annular resilient seal disposed between said tapered outer surface of said mandrel means and said tapered inner surface of said metering cartridge for sealing therebetween.

6. The apparatus for claim 1, wherein:

said selective sealing means is further characterized as a means for sealing between said metering cartridge and said mandrel means when said metering cartridge engages said second stop means of said mandrel means, and for allowing fluid flow between said portions of said metering chamber to bypass said fluid passage means of said metering cartridge when said metering cartridge is out of engagement with said second stop means.

7. The apparatus of claim 6, wherein:

said second stop means includes a conically tapered outer surface of said mandrel means, said tapered outer surface diverging away from said outer cylindrical surface of said mandrel means; and said metering cartridge includes an inner conically tapered surface at an end of said cartridge adjacent said second stop means, said tapered inner surface being so constructed as to closely fit about and engage said tapered outer surface of said mandrel means.

8. The apparatus of claim 7, wherein:

an internal cylindrical surface of said metering cartridge has an internal diameter greater than an outside diameter of said cylindrical outer surface of said mandrel means, thus defining an annular bypass passage between said mandrel means and said metering cartridge.

9. The apparatus of claim 7, wherein:

said selective sealing means includes an annular resilient seal disposed between said tapered outer surface of said mandrel means and said tapered inner surface of said metering cartridge for sealing therebetween.

10. The apparatus of claim 9, wherein:

said annular resilient seal is in an annular groove disposed in said tapered outer surface of said mandrel means.

11. A well tool apparatus, comprising:

an elongated cylindrical housing means;

mandrel means slidably received in said housing means and adapted to be longitudinally moved relative to said housing means to operate an operating assembly of said apparatus, said mandrel means being spaced radially inward from said housing means to define a longitudinally extending annular metering chamber therebetween, said mandrel means including a cylindrical outer surface and first and second stop shoulders extending radially outward from first and second ends, respectively, of said cylindrical outer surface;

an annular metering cartridge having a cylindrical inner surface concentrically and slidably disposed about said cylindrical outer surface of said mandrel means, and having first and second abutment shoulders extending radially outward from first and second ends, respectively, of said cylindrical inner surface, a longitudinal distance between said first and second abutment shoulders being sufficiently less than a longitudinal distance between said first and second stop shoulders so that said metering cartridge can slide out of engagement with either of said stop shoulders;

outer seal means for sealing between said metering cartridge and said housing means; and inner seal means for sealing between said second abutment shoulder and said second stop shoulder when said second abutment shoulder engages said second stop shoulder.

12. The apparatus of claim 11, wherein:

a fluid bypass passage is defined between said cylindrical outer surface of said mandrel means and said cylindrical inner surface of said metering cartridge and between said first abutment shoulder and said first stop shoulder when said first abutment shoulder is engaged with said first stop shoulder.

13. The apparatus of claim 11, wherein:

said second stop shoulder is further characterized as a conically tapered outer surface of said mandrel means, said tapered outer surface diverging away from said outer cylindrical surface of said mandrel means; and said second abutment shoulder is further characterized as a conically tapered inner surface of said metering cartridge which is so constructed as to closely fit about and engage said tapered outer surface of said mandrel means.

14. The apparatus of claim 11, wherein:

said apparatus is further characterized as a well tester tool and said operating assembly thereof is a valve means for opening and closing a flow passage of said well tester tool in response to reciprocation of a pipe string to which said well tester tool is connected; and said metering cartridge is further characterized as a means for providing a time delay between an initial application of longitudinal force to said pipe string and the operation of said valve means.

15. The apparatus of claim 11, wherein said metering cartridge comprises:

an inner barrel having said cylindrical inner surface of said metering cartridge defined thereon, said inner barrel having an enlarged outside diameter portion at a first end thereof having said first abutment shoulder defined thereon, and said inner barrel having a metering passage inlet disposed through said enlarged outside diameter portion;

an annular flow restricter ring closely received about a cylindrical outer surface of said inner barrel, and having a metering passage disposed therethrough with a fluid flow restricter disposed in said metering passage;

an annular outlet ring closely received about said cylindrical outer surface of said inner barrel adjacent a second end thereof, said outlet ring having said second abutment shoulder defined thereon, and having a metering passage outlet disposed through said outlet ring; and an outer barrel concentrically disposed about said enlarged diameter portion of said inner barrel, said flow restricter ring, and said outlet ring, said outer barrel having a radially inward extending shoulder engaging said first end of said inner barrel and having an internally threaded second end threadedly engaging a threaded outer surface of said outlet ring to thereby fixedly hold said inner barrel, said flow restricter ring, said outlet ring and said outer barrel together.

16. The apparatus of claim 15, wherein:

said outer seal means includes a cylindrical extensible barrel integrally formed with an extending longitudinally from a first end of said outer barrel, said extensible barrel having a cylindrical outer surface thereof which slidingly and sealingly engages a cylindrical inner surface of said housing means.

17. The apparatus of claim 15, wherein:

said second stop shoulder is further characterized as a conically tapered outer surface of said mandrel means, said tapered outer surface diverging away from said cylindrical outer surface of said mandrel means; and said second abutment shoulder is further characterized as a conically tapered inner surface of said outlet ring which is so constructed as to closely fit about and engage said tapered outer surface of said mandrel means.

* * * * *

UNITED STATES PATENT AND TRADEMARK OFFICE

CERTIFICATE OF CORRECTION

PATENT NO. : 4,579,174

DATED : April 1, 1986

INVENTOR(S) : Burchus Q. Barrington

It is certified that error appears in the above-identified patent and that said Letters Patent is hereby corrected as shown below:

In column 11, line 34, delete the word [loacted] and insert therefor --located--.

In column 14, line 64, delete the word [WHile] and insert therefor --While--.
In column 18, line 35, delete the word [an] and insert therefor --and--.

Signed and Sealed this

Third Day of February, 1987

*Attest:*

DONALD J. QUIGG

*Attesting Officer*

*Commissioner of Patents and Trademarks*